US005411225A

United States Patent [19]

Lannon et al.

[11] Patent Number: 5,411,225

[45] Date of Patent: May 2, 1995

[54] REUSABLE NON-PYROTECHNIC COUNTERMEASURE DISPENSER CARTRIDGE FOR AIRCRAFT

[76] Inventors: Robert G. Lannon, 1507 Palma Plz., Austin, Tex. 78703; William F. Weldon, 4707 Peace Pipe Path, Austin, Tex. 78746

[21] Appl. No.: 97,645

[22] Filed: Jul. 26, 1993

[51] Int. Cl.[6] ..... B64D 1/02

[52] U.S. Cl. ..... 244/137.1; 102/505; 124/77

[58] Field of Search ..... 244/137.1, 137.4, 147, 244/149, 146; 102/505; 89/1.54; 124/61, 70, 73, 74, 77

[56] References Cited

U.S. PATENT DOCUMENTS

| | | | |
|---|---|---|---|
| 1,852,439 | 4/1932 | Stone | 244/147 |
| 3,315,564 | 4/1967 | Hazlett, Jr. et al. | 124/77 |
| 3,453,853 | 7/1969 | Coleman et al. . | |
| 3,527,431 | 9/1970 | Wright . | |
| 3,547,000 | 12/1970 | Haberkorn | 244/137.4 |
| 3,706,997 | 12/1972 | Whatmore . | |
| 3,729,156 | 4/1973 | Wright . | |
| 3,741,125 | 6/1973 | LaPointe . | |
| 3,744,425 | 7/1973 | Grimm . | |
| 3,808,595 | 4/1974 | Coop et al. | 102/505 |
| 3,830,214 | 8/1974 | Curtis | 124/74 |
| 3,898,661 | 8/1975 | Kelly et al. . | |
| 4,134,115 | 1/1979 | Strom . | |
| 4,167,008 | 9/1979 | Blickenstaff . | |
| 4,183,302 | 1/1980 | Schillreff . | |
| 4,286,498 | 9/1981 | Block et al. . | |
| 4,304,517 | 12/1981 | Ulin . | |
| 4,307,665 | 12/1981 | Block et al. . | |
| 4,309,705 | 1/1982 | Ulin . | |
| 4,333,402 | 6/1982 | Landstrom et al. . | |
| 4,362,145 | 12/1982 | Stelcher | 124/77 |
| 4,404,912 | 9/1983 | Sindermann . | |
| 4,549,489 | 10/1985 | Billard et al. . | |
| 4,796,536 | 1/1989 | Yu et al. . | |
| 4,852,456 | 8/1989 | Thornburg | 102/505 |
| 4,899,662 | 2/1990 | Santalucia et al. . | |
| 5,026,310 | 6/1991 | Mackal et al. . | |
| 5,074,214 | 12/1991 | Zeren . | |
| 5,076,468 | 12/1991 | Mackal . | |
| 5,076,607 | 12/1991 | Woods et al. . | |

FOREIGN PATENT DOCUMENTS

| | | | |
|---|---|---|---|
| 588060 | 5/1977 | Switzerland | 124/77 |

*Primary Examiner*—Galen L. Barefoot
*Attorney, Agent, or Firm*—Gambrell, Wilson & Hamilton

[57] ABSTRACT

A non-pyrotechnic reusable cartridge for ejecting countermeasures, such as chaff, flares, or other payloads. The cartridge comprises a gas chamber storing a compressed gas and including an ejection mechanism and a countermeasure storage section storing a countermeasure. In one embodiment, the ejection mechanism is a solenoid valve. When an ejection signal is transmitted by the pilot, the solenoid valve opens to allow the compressed, non-flammable gas to be released from the gas chamber and push the countermeasure out of the cartridge at a high rate of speed. Other embodiments use a rupture disk positioned between the ejection section and the countermeasure storage section. When an eject signal is received, the rupture disk is either punctured or melted to allow the compressed gas into the storage section, thus ejecting the countermeasure. A non-pyrotechnic ejection mechanism allows safer handling, flashless dispensing, reuse of the cartridge, varied ejection force, and economical reloading with a variety of payloads.

18 Claims, 5 Drawing Sheets

REUSABLE NON-PYROTECHNIC COUNTERMEASURE DISPENSER CARTRIDGE FOR AIRCRAFT

FIELD OF THE INVENTION

The present invention relates to systems for ejecting payloads from aircraft, and more specifically to a non-pyrotechnic gas ejection mechanism and cartridge for ejecting countermeasures from aircraft.

DESCRIPTION OF THE RELATED ART

Various methods exist for shooting down military aircraft, including heat-seeking missiles and radar-guided missiles and radar directed gun shells that explode when they get close to the aircraft. One way to confuse radar-guided attacks is for the aircraft to emit a decoy, such as a "chaff cloud." Chaff is comprised of numerous bits of radar reflective material, such as aluminum-coated strips of fiberglass, that are cut to lengths that reflect half wavelengths of radar-threat frequencies. When chaff is ejected from an aircraft at a high rate of speed, a cloud of radar-reflecting material is formed. The chaff cloud projects a radar target larger than the aircraft itself, making the chaff cloud a more attractive target than the aircraft. Chaff is thus used as a decoy to confuse hostile radar. In addition to chaff, a flare is typically ejected from the aircraft in order to confuse a heat-seeking missile. A flare provides a heat source greater than that of the aircraft and thus provides a more attractive target to the heat-seeking missile. Recently, radio frequency (RF) emitter decoys have been developed which transmit frequencies that simulate a radar return. These RF decoys have their own power source and can be programmed before they are ejected from the aircraft. Chaff, flares and expendable jammers/RF decoys used in the above manners are referred to as "countermeasures."

FIG. 1 illustrates a countermeasure dispensing magazine and cartridge used in the prior art. The countermeasure dispenser includes a magazine, a cartridge, and an explosive squib. One end of the cartridge is preloaded with a countermeasure and is then lightly sealed with a cap (not shown) that comes off readily when the cartridge is fired. When cartridges are being prepared for loading in the aircraft, an explosive cap, referred to as a squib, is placed in a small opening of the cartridge as shown. The cartridge and the squib together are sometimes referred to as a round. A plurality of rounds are then loaded into the magazine, and a retainer plate is placed over the back of the magazine. The retainer plate secures the rounds in the magazine and includes holes which allow the transmission of "firing" and "polling" signals from a countermeasure dispenser system (CMD) to the cartridges, as described below. The magazines are then flushmounted in the underside of the wings or the fuselage of the aircraft. At that time, firing pins and grounding wires are connected to the squibs, and the rounds are then ready for firing.

The firing pins are controlled by an on-board countermeasure dispenser system (CMD). A CMD is a microprocessor controlled system which processes fire signals from the pilot and sends fire pulses to the appropriate rounds. The squib consists of a bridge wire embedded in explosives. When a fire pulse current is sent through the firing pin, the squib explodes, thereby ejecting the countermeasure from the magazine into the airstream around the aircraft. The CMD also accounts for the numbers of spent and unspent rounds using a process referred to as polling. During polling, the resistance of the bridge wire is measured by sending a small test current through the squib. Depending on the value of this measured resistance, the CMD determines whether or not the round is spent, i.e., was fired.

Currently, countermeasure dispensing cartridges used to eject countermeasures are generally used in either of two scenarios, these being training and actual combat. During peacetime, the vast majority of countermeasure cartridges are used in training sessions. One of the problems with current countermeasure ejection technology is the high cost of each cartridge. Due to costs and the fact that military budget cuts often target training costs there is a limitation on the number of rounds available for training. Consequently, the Air Force currently conducts practice training exercises with half-full chaff cartridges because of the high expense of the devices. A less expensive training round would result in a higher availability of rounds for training use. In addition, a less expensive wartime round would also obviously be beneficial.

A related problem is that each cartridge can only be fired once. Each cartridge is generally damaged by the explosive force of the squib, and thus after firing the cartridge must be discarded. This adds to the high per-round cost of current cartridges. As a result, technicians must replace both the squibs and their cartridges after every firing. In addition, explosive squibs are both dangerous and costly to handle. The U.S. Military classifies squibs as Class C explosives, and this classification requires special packaging and handling precautions which increase the cost of handling the squibs. This danger results in higher costs for shipping and storage. Another problem with the current countermeasure ejection technology is that when a round is fired at night, a flash of light is typically emitted from the cartridge that is potentially visible to enemy on the ground, aiding tracking of the aircraft.

Two further disadvantages of the prior art involve use with the new RF expendable decoy and the current technology's inability to alter the force of ejection. Current systems utilize the same circuit which fires the detonatable ejection mechanism to carry digital information to program the sophisticated RF expendable decoys. Unfortunately, once these circuits are used to program the RF expendables, the wires can become brittle and fail to fire the explosive squib or detonatable mixture, resulting in a jammed decoy which cannot be ejected from the magazine. In addition, the ejection force of detonable ejection mechanisms cannot be altered without changing the composition of the squib, U.S. Pat. No. 4,404,912 to Sindermann discloses a countermeasure dispensing cartridge which provides for complete ejection and uniform dispersion of countermeasures or dipoles. The cartridge uses a combination of sealing rings, guide surfaces and a plurality of pistons to achieve uniform dispersion. Sindermann also teaches a cartridge which uses a replaceable gas cartridge in conjunction with some form of detonation or ignition. For example, at column 1 beginning at line 18 prior art countermeasure ejection technology is discussed as including "an electrically detonatable pressured gas cartridge." Also, in the Summary of the Invention at column 2 beginning at line 34, Sindermann notes that a pressurized gas cartridge includes a "detonation side," implying that detonation is required to eject the countermeasure or dipole. In column 3 beginning at line 62, Sindermann notes that "at the detonation or ignition of the rearwardly stopped-up gas-charged cartridge in a manner not shown herein, the gas pressure drives the piston 6 [to eject the countermeasure]." Therefore, Sindermann discloses a gas cartridge which aids in countermeasure ejection but still requires detonation or ignition, i.e., some type of explosive force, in the ejection process. Therefore, the system shown in Sindermann has many of the same problems as the technology discussed above. First, detonation or ignition is required to fire the round, thus requiring special packaging and handling as well as the associated danger to the loading crew. In addition, although unclear from the disclosure in Sindermann, it can be assumed that detonation or ignition renders the cartridge non-reusable. Further, detonation or ignition will generally emit a flash when fired, thus possibly alerting enemy ground crews to the aircraft's presence.

Therefore, a new countermeasure ejection mechanism is desired which is non-pyrotechnic and hence reusable and thus reduces the per-round cost of the cartridge. A new ejection system is also desired which does not emit a flash of light during firing.

SUMMARY OF THE INVENTION

The present invention comprises a countermeasure cartridge compatible with current aircraft countermeasure dispensing systems (CMDs) that is safer and has a lower perround cost. The present invention uses a non-pyrotechnic ejection method, specifically a non-flammable compressed gas, such as air or nitrogen, that is stored within each cartridge to eject the countermeasure. This eliminates the danger and associated cost of handling hazardous explosives or ignitable gas cartridges and also eliminates the visible flash when fired. The ejection method of the present invention also does not damage the cartridge, enabling the cartridge to be recharged with compressed gas, reloaded with a new payload and reused numerous times. Further, compressed air is readily available at military air bases, allowing convenient and inexpensive recharging of the cartridge. Also, the pressure of the compressed gas can be varied to change the velocity of ejection of the payload.

In the preferred embodiment of the invention, the cartridge includes a countermeasure ejection or firing section having a gas chamber and a countermeasure storage section storing a countermeasure. The required energy for ejection of the countermeasure is stored in the form of compressed gas inside the gas chamber. A solenoid valve separates the gas chamber from the storage section, and a piston is preferably situated between the valve and the countermeasure. A launch signal triggers the solenoid valve to open, thus releasing the gas. The gas expands through the remainder of the cartridge propelling the piston and countermeasure out of the cartridge at a high velocity.

In an alternate embodiment, the compressed gas is stored in a removable gas cartridge inside the countermeasure ejection section. The gas cartridge is screwed into the ejection or firing end of the cartridge. The gas cartridge also screws into a solenoid valve that connects to the countermeasure storage section of the cartridge. When the launch signal is triggered, the solenoid valve opens which causes the gas from the gas cartridge to release and expand through the cartridge, thus propelling the piston and countermeasure out of the cartridge.

In another embodiment of the invention, a solenoid stopper is used to release the gas and eject the countermeasure. A retracting plunger or stopper is placed in an orifice between the gas chamber and the countermeasure storage section and is used to contain compressed gas within the gas chamber. A launch signal initiates ejection of the payload or countermeasure by triggering the solenoid to pull the rubber plunger from the orifice between the gas chamber and storage section. When the orifice is opened, the gas expands into the countermeasure storage section and propels the piston and countermeasure out of the cartridge.

Two other embodiments use a rupture disk to aid in ejecting the countermeasure. In each embodiment, a specially configured rupture disk retains and seals compressed gas in the gas chamber. In one embodiment using a hot-wired rupture disk, amplification circuitry in the countermeasure ejection section amplifies the firing signal to heat a filament in the disk. This weakens the disk and causes it to open or rupture. Once the disk opens, the highly pressurized gas ejects the piston and countermeasure out of the cartridge. The second embodiment uses a puncture method to rupture the disk. When a launch signal is received, a puncture plunger inside the ejection section pierces the disk, thus releasing the pressurized gas to propel the piston and countermeasure out of the cartridge.

In the above two embodiments, the cartridge can preferably be dismantled to allow the consumable portion of the cartridge, such as the rupture disk, to be replaced.

Therefore, the present invention comprises a reusable countermeasure cartridge using a non-pyrotechnic ejection mechanism. The present invention is reusable and thus has the benefits of lower per-round cost, as well as safer and quicker handling and preparation. In addition, the ejection mechanism of the present invention does not emit a flash when fired and can vary the force of ejection. Also, there is much less of a problem with deterioration while programming RF expendables.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE PREFERRED EMBODIMENT

Figure 1:
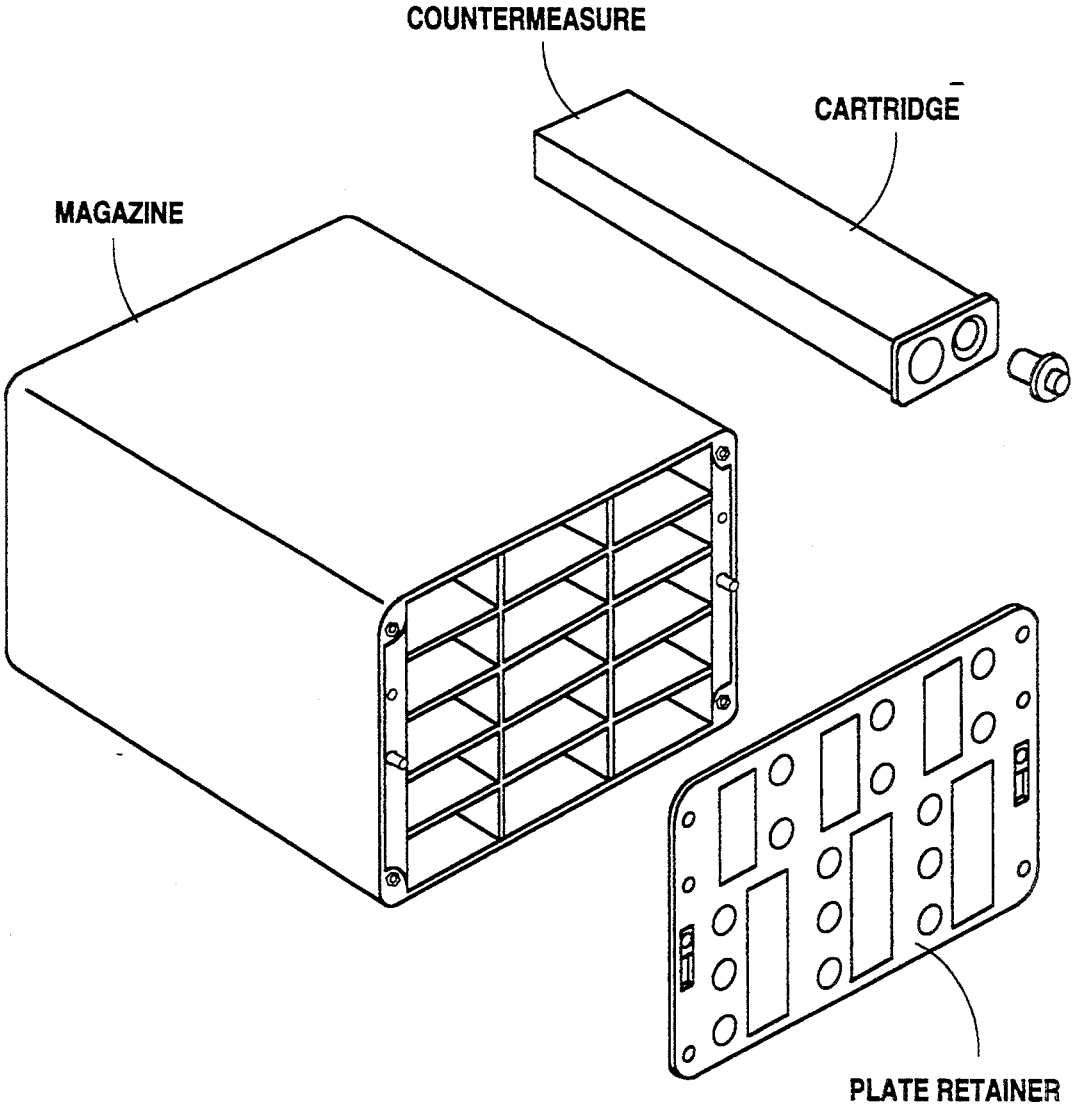
Fig. 1 (PRIOR ART)
FIG. 1 is a prior art diagram illustrating a countermeasure magazine and cartridge.
Figure 2:
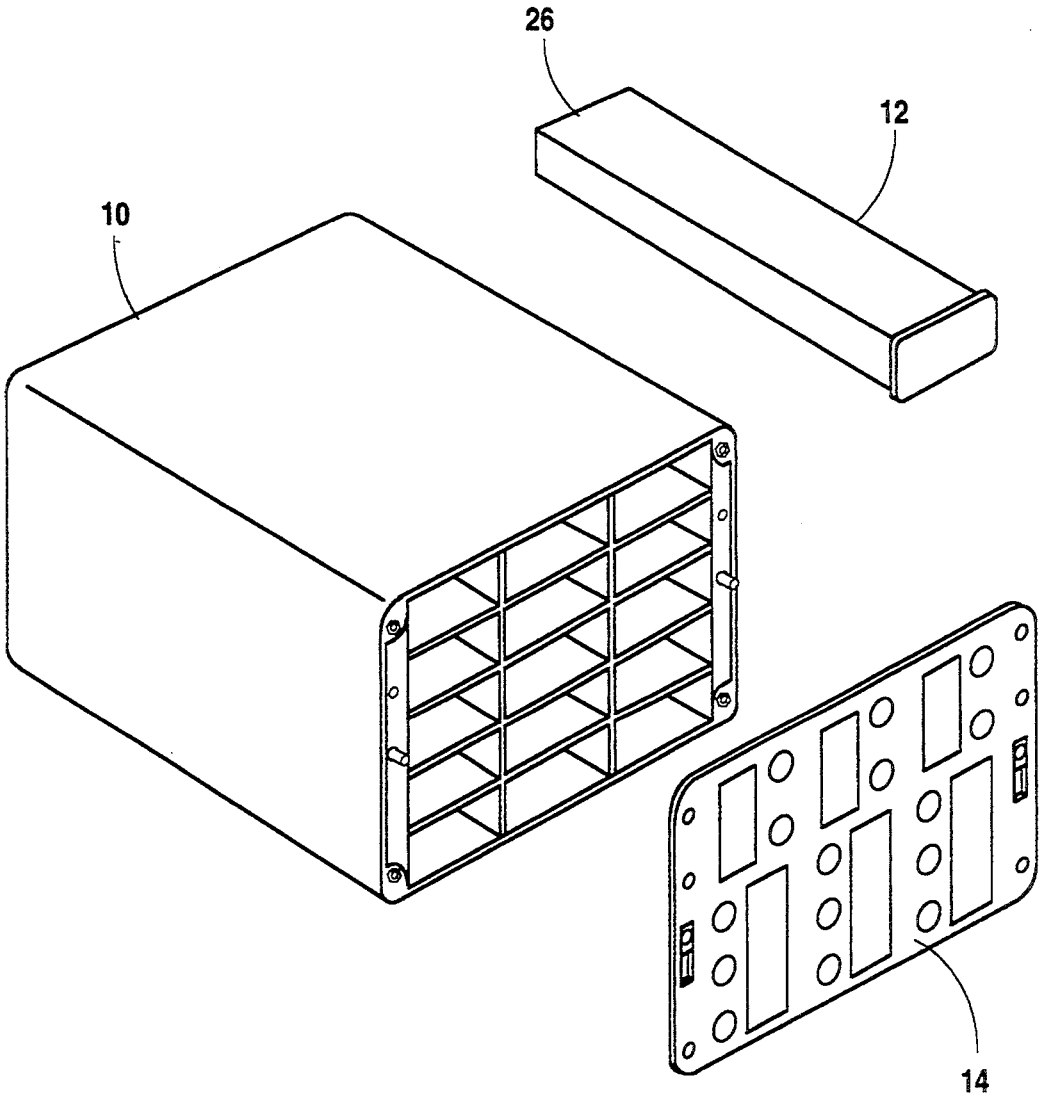
FIG. 2 illustrates a countermeasure magazine and a cartridge according to one embodiment of the invention.

Referring now to FIG. 2, a countermeasure magazine 10 and cartridge 12 according to the present invention are shown. The cartridge 12 stores a countermeasure 26 as shown. In the description that follows, the term countermeasure is intended to apply to chaff, flares, RF decoys, or any other substance or device which is desired to be ejected from an aircraft. The magazine 10 is preferably identical to those used in the prior art. A retainer plate 14 is included for attachment to the back of the magazine 10 to hold the cartridges 12 in the magazine 10 after the cartridges 12 are loaded into the magazine 10. The magazine 10 is then mounted into the wing or fuselage of an aircraft (not shown) or other vehicle, and the cartridges 12 are connected to the aircraft's firing system (also not shown). The following description discusses the present invention with regard to aircraft. However, it is noted that the cartridge and ejection mechanism of the present invention can be used in any type of vehicle, military or commercial, and can be used in other applications to eject various substances as desired.

Figure 3:
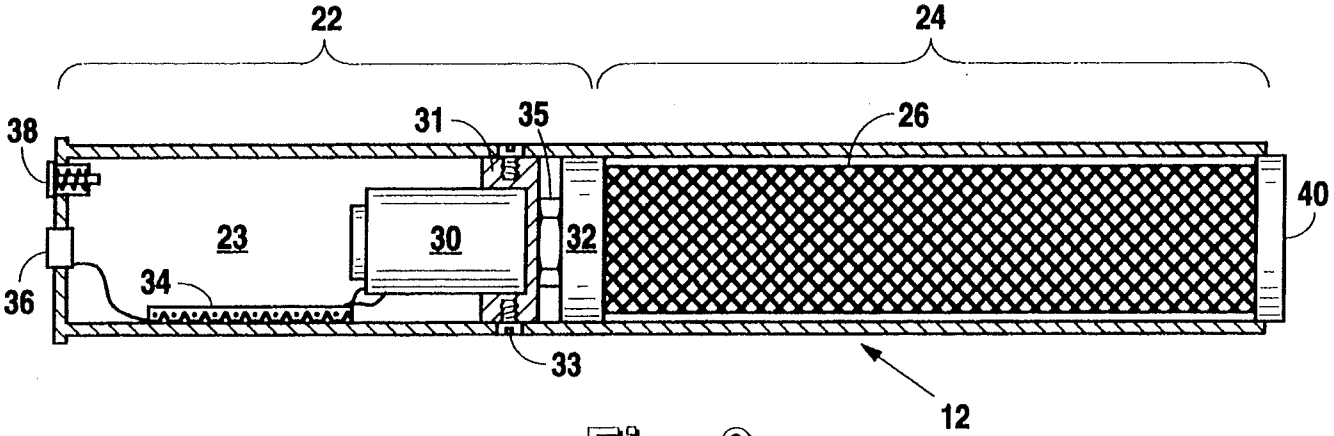
FIG. 3 illustrates a countermeasure cartridge using a solenoid valve to actuate the release of compressed gas according to the preferred embodiment of the invention.

FIG. 3 illustrates a cartridge for the ejection of countermeasures according to the preferred embodiment of the invention. As can be seen, the cartridge 12 comprises a hollow tube having a square cross-section, sealed at one end, referred to as the firing end, and capped at the other end, referred to as the storage end. The cartridge 12 comprises two sections, a countermeasure ejection or firing section 22 and a countermeasure storage section 24. A countermeasure 26 such as chaff is stored in the countermeasure storage section 24. However, as mentioned above, any substance or "payload" can be stored in the storage section 24. The countermeasure 26 is placed in the countermeasure storage section 24 of the cartridge 12 and a plastic cap 40 is used to seal the end.

The walls of the countermeasure ejection section 22 define a volume or gas chamber 23 for receiving compressed gas. A firing pin contact 36 is included on the firing end of the cartridge 12. The firing pin contact 36 is electrically connected to an amplification circuit 34 which in turn is electrically connected to a solenoid valve 30. The amplification circuit 34 simulates the electrical characteristics of existing countermeasure cartridges as well as provides the proper electrical stimulation of the solenoid 30. The amplification circuit 34 is preferably mounted on one wall of the cartridge 12 in the ejection section 22, as shown. The solenoid valve 30 is positioned between the gas chamber 23 and the countermeasure storage section 24 and, in the closed position, seals the compressed gas in the gas chamber 23. The solenoid valve 30 acts as a gas release mechanism and is used to release compressed gas from the gas chamber 23 into the storage section 24, thus ejecting the countermeasure 26. The solenoid valve 30 is held in place by a solenoid anchor disk 31 which is attached to the walls of the cartridge 12 by means of screws 33. A piston 32 is positioned between the solenoid valve 30 and the countermeasure 26. A nut 35 is positioned between the solenoid valve 30 and the piston 32 and helps to guide the compressed gas from the solenoid valve 30 against the piston 32. The firing pin contact 36 also connects to an aircraft's countermeasure dispensing firing and control systems (CMD) (not shown).

A gas fill/bleed valve 38 is mounted in the firing end of the cartridge 12 and is used to place compressed gas into the gas chamber 23. The gas valve 38 is preferably a Schrader type valve. The top of the valve 38 preferably rests flush with the end of the casing so that the cartridge 12 may properly sit in the magazine 10. The valve 38 preferably operates the same way as the valve in an automobile tire. To fill the gas chamber 23 in the ejection section 22, an air hose (not shown) connects to the valve 38 and pressurized air flows through the valve into the chamber 23. An external gauge on the air line monitors the pressure in the chamber 23, or alternatively another pressure relief valve can be provided in a similar manner as the valve 38.

In the preferred embodiment compressed air is used as the compressed gas because it is not pyrotechnic or explosive as defined by U.S. Military specifications. Compressed air is also preferred because military bases such as Bergstrom Air Force Base in Austin, Tex. use compressed air in servicing aircraft. On the flight line, the military uses highly filtered compressed air which is extremely dry and clean. Therefore, the compressed air closely behaves as an ideal gas since much of the water vapor has been removed. Ideal gas behavior increases the performance of the ejection process. Also the air on the flight line is available at pressures ranging from 0 to 3,500 psig, and this variable pressure source can be used to eject generic payloads simply by altering the pressure in the cartridge's gas chamber 23.

When a pilot desires to eject the countermeasure 26 from his aircraft, the following events occur. First, the pilot presses a firing button (not shown) and the CMD system directs a firing signal to the firing pin of a respective cartridge 12 loaded in the countermeasure magazine 10. The firing signal is provided from the firing pin contact 36 to the amplification circuit 34 which amplifies the signal and in turn provides the signal to the solenoid valve 30. This signal causes the solenoid valve 30 to open thus releasing the compressed gas in the gas chamber 23. The compressed gas passes through the solenoid valve 30 and nut 35 against the piston 32, forcing the piston 32 toward the storage end of the cartridge 12 where the plastic cap 40 is attached. The force of the piston 32 expels the countermeasure 26 and plastic cap 40 from the cartridge 12 thus ejecting the countermeasure 26.

Figure 4:
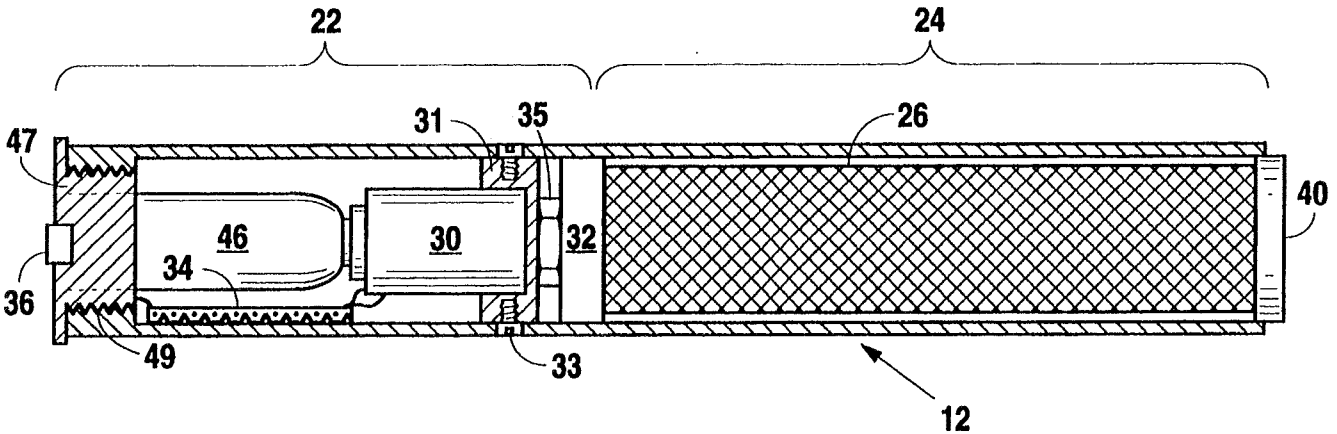
FIG. 4 illustrates a countermeasure cartridge which uses a solenoid valve and a removable gas cartridge.

FIG. 4 illustrates another embodiment of the invention which is similar to that illustrated in FIG. 3. This embodiment includes a countermeasure ejection section 22 including an ejection mechanism and a countermeasure storage section 24 storing a countermeasure 26. The only difference between the embodiment shown in FIG. 3 and that shown in FIG. 4 is that a removable gas cartridge 46 is used as a gas chamber to store compressed gas, instead of merely using the interior volume of the countermeasure ejection section 22 as a gas chamber 23. The gas cylinder 46 includes a screw cap/holder 47 which mates with threads 49 located at the firing end of the cartridge 12. The end of the gas cartridge 46 opposite the screw cap/holder 47 also screws into the solenoid valve 30. In this manner, the gas cylinder 46 may be removed and inserted via the screw cap holder 47. When a countermeasure cartridge 12 has been spent, i.e. has been used, the gas cartridge 46 can simply be removed, refilled and then reinserted into the cartridge 12 for reuse. One disadvantage of this method is that more handling is required to prepare the cartridge 12, and the use of a gas cartridge 46 increases the overall cost of the cartridge 12.

Figure 5:
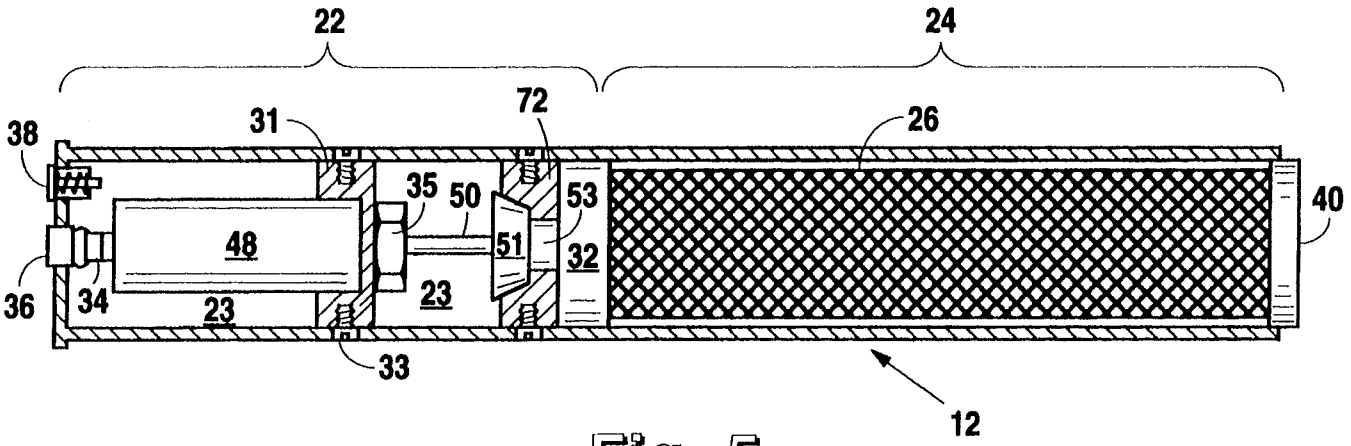
FIG. 5 illustrates a cartridge utilizing a solenoid with a retracting plunger to actuate the release of compressed gas.

FIG. 5 illustrates another embodiment of the invention which is also similar to that illustrated in FIG. 3. This embodiment includes a countermeasure ejection section 22 having a gas chamber 23 and a countermeasure storage section 24 storing a countermeasure 26. As with the embodiment in FIG. 3, the walls of the cartridge 12 in the ejection section 22 comprise a volume forming gas chamber 23.

As shown in FIG. 5, the firing pin contact 36 is connected through an amplification circuit 34 to a solenoid plunger comprising a solenoid 48, retracting plunger 50 and rubber stopper 51. The solenoid 48 is anchored to the walls of the cartridge 12 by means of a solenoid anchor disk 31 which is attached by means of screws 33. The retracting plunger 50 which includes rubber stopper 51 is operatively connected to the solenoid 48. A nut is connected to the solenoid anchor disk 31 and aids in guiding the retracting plunger 50. A sealed ring 72 is positioned between the gas chamber 23 in the ejection section 22 and the storage section 24. The sealed ring 72 includes an orifice 53 connecting the gas chamber 23 with the storage section 24. The rubber stopper 51 is used to seal the orifice 53 between the gas chamber 23 and the storage section 24 when the solenoid 48 is in a first state. When the solenoid 48 is in a second state, the plunger 50 is retracted and the rubber stopper 51 no longer seals the orifice 53. A piston 32 is positioned between the orifice 53 and the countermeasure 26 stored in the countermeasure storage section 24.

When a firing signal is transmitted by the pilot to the firing pin contact 36, the solenoid plunger 48 operates to retract the retracting plunger 50 thus removing the rubber stopper 51 from the orifice 53. This allows compressed gas in the gas chamber 23 of the cartridge 12 to expand against the piston 32, thus acting to eject the plastic cap 40 and countermeasure 26.

To prepare the cartridge described in FIGS. 3, 4, or 5 for use, the countermeasure 26 is loaded into the cartridge 12, and the cap 40 is attached. Just prior to the cartridge 12 being loaded into the magazine 10, (see FIG. 2) the compressed gas is loaded. With respect to the embodiments in FIGS. 3 or 4, a pressure fitting is attached to the gas fill/bleed valve 38, and the gas chamber 23 is pressurized using a non-flammable gas, preferably air as discussed above. However, nitrogen may also be used. With respect to the embodiment of FIG. 5, the compressed gas cylinder 46 is screwed into the countermeasure ejection section 22. A plurality of cartridges 12 are then loaded into the magazine 10, the retainer plate 14 is attached, and the firing pin 36 of each cartridge 12 is connected to the aircraft as is well known in the art. In the embodiments of FIG. 3 and 4, when an appropriate electrical signal is transmitted by the pilot via the CMD to the respective cartridge 12, the solenoid valve 30 is activated and the valve 30 opens, allowing the gas to expand into the storage section 24 and propel the piston 32, countermeasure 26, and the cap 40 rapidly out of the cartridge at a high velocity. In the embodiment of FIG. 5, the firing signal activates the solenoid 48 which retracts the retracting plunger 50 and allows the compressed gas to expand into the storage section 24, thus expelling the countermeasure 26.

After the aircraft returns to base, the magazine 10 may be removed from the aircraft and the spent cartridges are removed from the magazine. As the countermeasure was expelled without detonation or ignition, i.e., without any explosive force, the spent cartridges are not damaged, and they can be reused numerous times. Spent cartridges are reloaded, repressurized, and used again, repeating the steps listed above.

Figure 6:
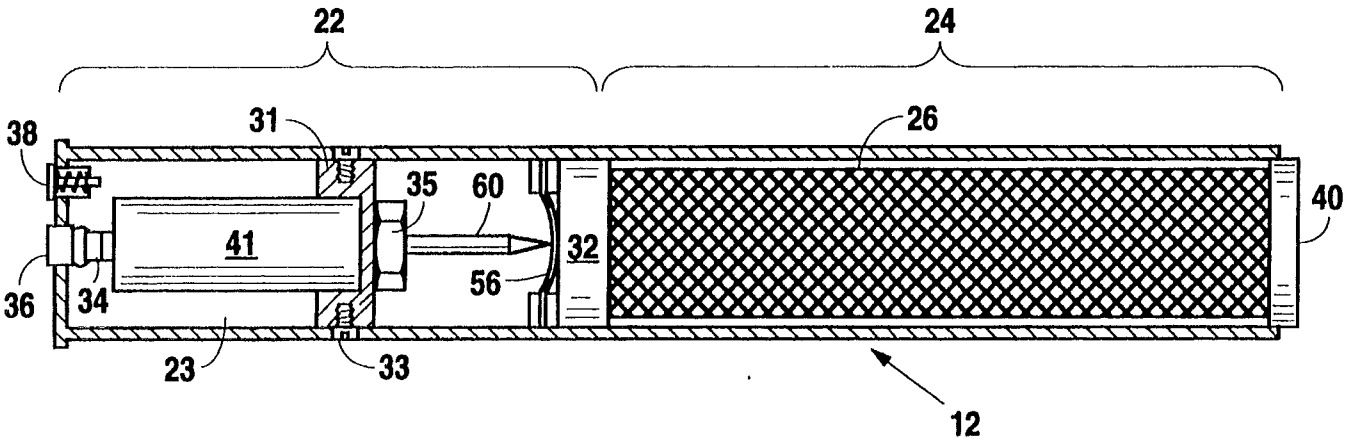
FIG. 6 illustrates a cartridge utilizing a puncture plunger to pierce a rupture disk to actuate the release of compressed gas.

FIG. 6 illustrates a cartridge using a punctured rupture disk as a gas release mechanism according to another embodiment of the invention. In this embodiment, the cartridge 12 includes a countermeasure ejection section and a countermeasure storage section 24. As with the embodiments of FIGS. 3 and 5, the walls of the cartridge 12 in the ejection section 22 comprise a volume forming gas chamber 23. Compressed gas is inserted into the gas chamber via gas fill/bleed valve 38. A rupture disk or diaphragm 56, preferably a thin scored aluminum disk, separates the compressed air in the gas chamber 23 from the countermeasure storage section 24. The rupture disk 56 is retained in its position by a band or retaining ring which circles a retaining lip. This band prevents air pressure inside the gas chamber 23 from distorting the disk 56 and causing it to leak or become displaced. One end of the cartridge 12 corresponding to the ejection section 22 includes a firing pin contact 36 which connects through amplification circuit 34 to a solenoid plunger 48. The solenoid plunger 48 is held in place by a solenoid anchor disk 31 which is connected to the walls of the cartridge 12. The solenoid plunger 48 is operatively connected to a puncture plunger 60 whose tip is proximate to the rupture disk 56 when the solenoid 48 is in a first state. The solenoid 48 may also enter a second state where it extends to the puncture plunger 60 through the rupture disk 56. A piston 32 is positioned between the rupture disk 56 and the countermeasure 26 and is positioned on the opposite side of the rupture disk 56 relative to the puncture plunger 60.

When a pilot desires to eject the countermeasure 26, he presses a button which asserts a fire signal to the firing pin contact of the cartridge 36. This signal causes the solenoid plunger 48 to enter its second state and extend the puncture plunger 60 to pierce the rupture disk 56 thus causing a complete opening of the disk 56. A small magnet (not shown) is preferably glued in the solenoid mount and retains the solenoid 48 in its first state when the solenoid 48 is not energized. The magnet prevents the plunger 60 from moving back and forth and puncturing the rupture disk 56 during high G-force maneuvers. However, when the solenoid 48 is energized to its second state, the solenoid 48 produces enough force to overcome the magnet's attractive force.

An advantage of this embodiment is that the solenoid 48 requires little force to puncture the rupture disk 56 and cause a complete rupture. One disadvantage to the above embodiment is that the solenoid 48 will actuate on any signal. Thus, the amplication circuit 24 is included to interpret between polling and firing pulses from the CMD in order to prevent premature firing of the payload or countermeasure during polling.

Figure 7:
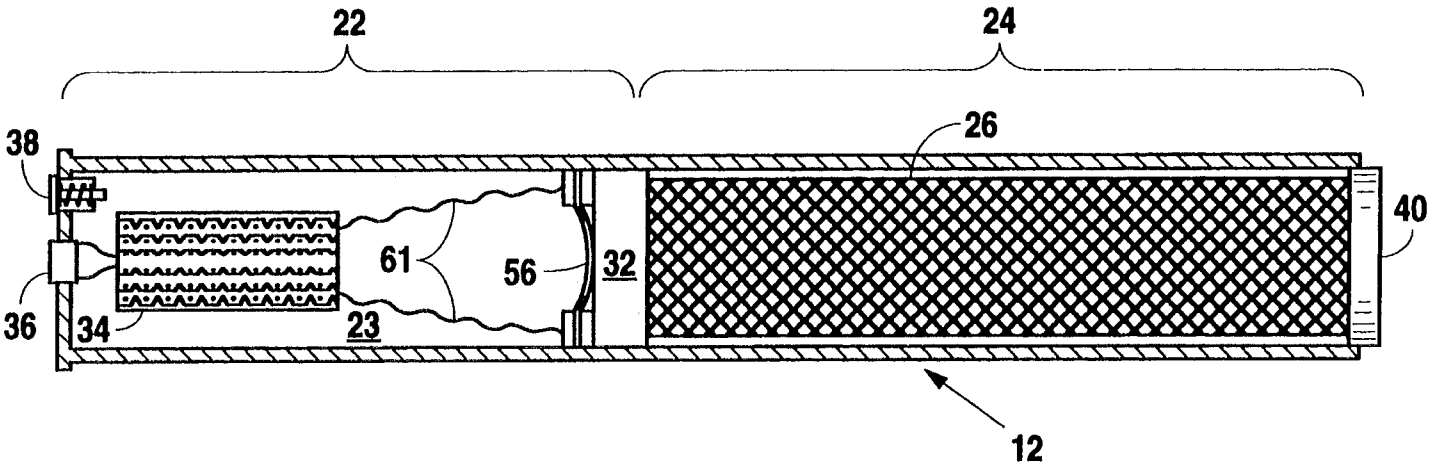
FIG. 7 illustrates a cartridge utilizing a hot wire rupture disk to actuate the release of compressed gas.

In the embodiments illustrated in FIGS. 6 and 7, the countermeasure ejection section 22 and the countermeasure storage section 24 can be separated. The two sections 22 and 24 are preferably circular and threaded in a complementary fashion 52 where the countermeasure ejection section 22 and the countermeasure storage section 24 meet so that they can be firmly and sealingly connected. A retaining ring 54 is permanently attached to the walls of the countermeasure ejection section 22, just below the threads 52. The rupture disk 56, which is preferably comprised of aluminum with approximately 0.003" thickness is placed on this ring 54. A removable retainer ring 58 is then placed on top of the rupture disk 56, and is positioned such that, when the countermeasure ejection section 22 and the countermeasure storage section 24 are screwed together, the rupture disk 56 is firmly pinned between the two retaining rings 54 and 58.

FIG. 7 illustrates an embodiment similar to the embodiment in FIG. 6 which uses a "hot wire" rupture disk 62 to affect the release of the compressed gas in place of the solenoid 48 and puncture plunger 60 used in FIG. 6. As with the embodiment of FIG. 6, a rupture disk or diaphragm 56 is connected between the gas chamber 23 defined by the walls of the cartridge 23 and the countermeasure storage section 24. In this embodiment, the firing pin contact 36 is connected to an amplification circuit 34 which in turn is connected to the rupture disk 56 by means of wires 61. Piston 32 is connected between the rupture disk 56 and the countermeasure 26 and is situated on the opposite side of the gas chamber 23 relative to the rupture disk 56. When a countermeasure ejection signal is received, the signal is passed through the firing pin contact 36 and amplified by the amplification circuit 34. The signal is then passed by the wires 61 to a filament (not shown) in the rupture disk 56. The amplified signal produces heat which melts the filament in the rupture disk 56 and weakens the disk 56, causing it to rupture or open. Once the disk has ruptured or has opened, the highly pressurized gas in the gas chamber 23 propels the countermeasure 26, piston 32, and plastic cap 40 out of the cartridge 12.

One advantage of this design is that the configuration limits the amount of circuitry necessary to distinguish between polling and firing signals. The filament across the rupture disk is preferably designed to initially display a certain resistance for polling signals. During firing, the filament melts resulting in an open circuit across the two wires. Thus, on a subsequent polling, the resistance is very high, indicating a spent round.

To prepare the cartridge of either FIGS. 6 or 7 for use, the two sections 22 and 24 are first separated. The rupture disk 56 is placed on the permanent retaining ring 54 and the removable retaining ring 58 is placed on top of the rupture disk 56. The two units 22 and 24 are then screwed firmly together at their threaded connections 52. The countermeasure 26 is then loaded into the countermeasure storage section 24 of the tube, and the cap 40 is attached. The cartridge 12 is then pressurized and mounted into the magazine 10, which in turn is mounted into the aircraft. When the pilot asserts a countermeasure ejection signal via the CMD, the rupture disk 56 is ruptured. In the embodiment illustrated in FIG. 6, the solenoid 48 is activated, and the needle plunger 60 pierces the rupture disk 56. In the embodiment illustrated in FIG. 7, an electrical current flows across the disk 56 causing it to melt and rupture. In either case, the rupturing of the disk 56 causes the compressed gas to expand, propelling the piston 32, the countermeasure 26, and the cap 40 out of the cartridge at a high velocity.

After the aircraft returns to base, the magazine 10 may be removed from the aircraft, and the cartridges 12 may be removed from the magazine 10. The cartridge may then be disassembled, reloaded, repressurized, and used again, repeating the steps listed above.

One disadvantage of the embodiments illustrated in FIGS. 6 and 7 relative to the preferred embodiment of FIG. 3 is that these embodiments take longer to prepare for service and have consumable parts that result in increased costs.

Although the method and apparatus of the present invention has been described in connection with the preferred embodiment, it is not intended to be limited to the specific form set forth herein, but on the contrary, it is intended to cover such alternatives, modifications, and equivalents, as can be reasonably included within the spirit and scope of the invention as defined by the appended claims.

We claim:

1. A reusable, self-contained, refillable non-pyrotechnic countermeasure dispensing cartridge, comprising:

a countermeasure storage section comprised in said countermeasure dispensing cartridge for storing one or more countermeasures;

a self-contained gas chamber comprised in said countermeasure dispensing cartridge for storing compressed gas; and a self-contained non-pyrotechnic gas release mechanism comprised in said countermeasure dispensing cartridge positioned between said gas chamber and said countermeasure storage section which may be activated to release said compressed gas from said gas chamber into said countermeasure storage section, thus ejecting said one or more countermeasures.

2. The countermeasure dispensing cartridge of claim 1, wherein said gas chamber comprises a self-contained, removable, reusable gas cartridge comprised within said countermeasure dispensing cartridge.

3. The countermeasure dispensing cartridge of claim 1, wherein said countermeasure dispensing cartridge further comprises a countermeasure ejection section, wherein said non-pyrotechnic gas release mechanism is housed in said countermeasure ejection section;

wherein said countermeasure ejection section includes walls defining said gas chamber.

4. The countermeasure dispensing cartridge of claim 3, further comprising a gas fill valve mounted on said countermeasure ejection section for refilling said gas chamber.

5. The countermeasure dispensing cartridge of claim 4, wherein said gas comprises air.

6. The countermeasure dispensing cartridge of claim 1, further comprising a contact which receives an ejection signal and provides said ejection signal to said non-pyrotechnic gas release mechanism to activate said gas release mechanism.

7. The countermeasure dispensing cartridge of claim 6 further comprising: an amplification circuit coupled between said firing pin and said non-pyrotechnic gas release mechanism.

8. The countermeasure dispensing cartridge of claim 1, further comprising: a piston positioned between said gas chamber and said countermeasure storage section.

9. The countermeasure dispensing cartridge of claim 1, wherein said nonpyrotechnic gas release mechanism comprises a solenoid valve positioned between said gas chamber and said countermeasure storage section.

10. The countermeasure dispensing cartridge of claim 1, further comprising: a seal positioned between said gas chamber and said countermeasure storage section, wherein said seal includes an orifice; wherein said non-pyrotechnic gas release mechanism comprises:

a solenoid having first and second states; and a stopper plunger operatively connected to said solenoid and positioned in said orifice when said solenoid is in said first state to prevent said compressed gas from entering said countermeasure storage section;

wherein when said gas release mechanism is activated said solenoid enters said second state and removes said stopper plunger from said orifice, thus causing said compressed gas to enter said countermeasure storage section and eject said countermeasure.

11. The countermeasure dispensing cartridge of claim 1, wherein said gas release mechanism comprises:

a rupture disk positioned between said gas chamber and said countermeasure storage section;

a solenoid having first and second states; and a puncture plunger operatively connected to said solenoid and positioned proximate to said rupture disk when said solenoid is in said first state;

wherein when said gas release mechanism is activated said solenoid enters said second sate and thrusts said puncture plunger into said rupture disk, causing said compressed gas to enter said countermeasure storage section and eject said countermeasure.

12. The countermeasure dispensing cartridge of claim 1, wherein said gas release mechanism comprises:

a hot wire rupture disk positioned between said gas chamber and said countermeasure storage section; a firing pin contact mounted on said cartridge; and a wire connecting said firing pin contact to said hot wire rupture disk;

wherein when said firing pin contact receives an eject signal, said eject signal is provided through said wire to said hot wire rupture disk to cause said rupture disk to open, thereby causing said compressed gas to enter said countermeasure storage section and eject said countermeasure.

13. An apparatus for ejecting a payload, comprising:

a reusable, self-contained, refillable dispensing cartridge;

a storage section comprised within said dispensing cartridge for storing the payload;

a gas chamber comprised within said dispensing cartridge for storing compressed gas; and a non-pyrotechnic gas release mechanism positioned in said dispensing cartridge between said gas chamber and said storage section which can be activated to release said compressed gas from said gas chamber into said storage section, thus ejecting the payload.

14. The apparatus of claim 13, further comprising:

a piston positioned between said gas chamber and said storage section.

15. The apparatus of claim 13, wherein said non-pyrotechnic gas release mechanism comprises a solenoid valve positioned between said gas chamber and said storage section.

16. The apparatus of claim 13, further comprising:

a seal positioned between said gas chamber and said storage section, wherein said seal includes an orifice;

wherein said non-pyrotechnic gas release mechanism comprises:

a solenoid comprised within said dispensing cartridge having first and second states; and a stopper plunger operatively connected to said solenoid and positioned in said orifice when said solenoid is in said first state to prevent said compressed gas from entering said storage section;

wherein when said gas release mechanism activated said solenoid enters said second state and removes said stopper plunger from said orifice, thus causing said compressed gas to enter said storage section and eject the payload.

17. The apparatus of claim 13, wherein said gas release mechanism comprises:

a rupture disk comprised in said dispensing cartridge and positioned between said gas chamber and said storage section;

a solenoid comprised in said dispensing cartridge and having first and second states; and a puncture plunger operatively connected to said solenoid and positioned proximate to said rupture disk when said solenoid is in said first state;

wherein when said gas release mechanism is activated said solenoid enters said second sate and thrusts said puncture plunger into said rupture disk, causing said compressed gas to enter said storage section and eject the payload.

18. The apparatus of claim 13, wherein said gas release mechanism comprises:

a hot wire rupture disk positioned between said gas chamber and said storage section;

a firing pin contact mounted on said dispensing cartridge;

a wire connecting said firing pin contact to said hot wire rupture disk;

wherein when said firing pin contact receives an eject signal, said eject signal is provided through said wire to said hot wire rupture disk to cause said rupture disk to open, thereby causing said compressed gas to enter said storage section and eject the payload.

* * * * *